United States Patent [19]

Hillstrom

[11] Patent Number: 4,861,397

[45] Date of Patent: Aug. 29, 1989

[54] FIRE-RESISTANT EXPLOSIVES

[75] Inventor: Warren W. Hillstrom, Bel Air, Md.

[73] Assignee: The United States of America as represented by the Secretary of the Army, Washington, D.C.

[21] Appl. No.: 166,070

[22] Filed: Mar. 9, 1988

[51] Int. Cl.[4] ..... C06B 45/10

[52] U.S. Cl. ..... 149/19.4; 140/19.1; 140/19.91

[58] Field of Search ..... 149/19.1, 19.3, 19.4

[56] References Cited

U.S. PATENT DOCUMENTS

| | | | |
|---|---|---|---|
| 3,632,458 | 1/1972 | Filter et al. | 149/19.3 |
| 3,726,829 | 4/1973 | Sayles | 149/19.4 |
| 3,925,122 | 12/1975 | Berthmann et al. | 149/19.91 |
| 3,972,820 | 8/1976 | Filter et al. | 149/83 |
| 3,977,923 | 8/1976 | Uelzmann | 149/19.1 |
| 4,078,953 | 3/1978 | Sayles | 149/19.4 |
| 4,137,849 | 2/1979 | Hontgas et al. | 149/19.91 |
| 4,158,583 | 6/1979 | Frosch | 149/19.4 |
| 4,180,424 | 12/1979 | Reed et al. | 149/19.4 |
| 4,289,551 | 9/1981 | Perrault et al. | 149/19.4 |
| 4,472,214 | 9/1984 | Flanagan et al. | 149/19.1 |

OTHER PUBLICATIONS

Caveny et al., "Evaluation of Additives to Reduce Solid Propellant Flammabilty in Ambient Air", Ballistic Research Laboratory, Contract Report No. 278, (Dec. 1975).

Hawley, "The Condensed Chemical Dictionary", 9th Ed., p. 880, Van Nostand Reinhold Company (1977) New York.

*Primary Examiner*—Edward A. Miller

*Attorney, Agent, or Firm*—Saul Elbaum; Muzio B. Roberto; Guy M. Miller

[57] ABSTRACT

A fire resistant composition comprising an explosive in an amount of 41–85%, an additive selected from the group consisting of zinc borate, hexabromobiphenyl, molybdenum flame suppressant, triaryl phosphate ester, calcium formate, antimony oxide, ammonium phosphate, aluminum oxide trihydrate, and organophosphorous diols in an amount of 9–41% and a binder component selected from the group consisting of polyurethane, acrylic polymers, phosphate ester-vinyl chloride latexes, cellulose acetate butyrate, vinyl esters, styrene-ethylene butylene block copolymers fluorinated elastomers, and Plaster of Paris rubberized with acrylic latexes in an amount of 6–39%, all of proportions being on a % by weight basis.

2 Claims, No Drawings

FIRE-RESISTANT EXPLOSIVES

The invention described herein may be manufactured, used and licensed by or for the Government for Governmental purposes without payment to me of any royalties thereon.

BACKGROUND OF THE INVENTION

The present invention relates to the area of explosive materials and more specifically to the stabilization of explosives which are normally susceptible to thermal initiation of catastrophic decomposition with large associated damage.

Heat has present hazards for explosives since they have been known and used. In combat, ammunition is considered vulnerable and, consequently, measures are taken to protect it from incendiaries, fuel fires and other threats. In noncombat situaitons, accidental ignitions occur through excessive heating of energetic materials in their manufacture, transport or storage. An example of destructive self heating is the explosion of 7 million pounds of fertilizer grade ammonium nitrate at Texas City, Tex. with the resultant fatalities of over 560 persons. In that catastrophe, two separate shiploads of the ammonium nitrate exploded in the harbor after self heating to the ignition temperature.

Common explosives used by the military are 2,4,6-trinitrotoluene (TNT); hexahydro-1,3,5-trinitro-1,3,5-triazine (RDX); octahydro-1,3,5,7-tetranitro-1,3,5,7-tetrazocine (HMX), and 2,2-bis[(nitroxy)methyl]-1,3 -propanediol dinitrate (PETN) in combination with inert binders. Since heat accelerates chemical reaction, it would be beneficial to stabilize these explosive materials to prevent thermal initiation of catastrophic decomposition and yet allow them to initiate and perform when exposed to a fully developed detonation wave form a booster explosive.

Attempts have been made to prevent undesirable thermal initiations in propellants by the use of additives. These approaches have not been reported for explosives. For example, L. H. Caveny et al. Ballistic Research Laboratory, Contract Report No. 278, entitled. "Evaluation of additives to reduce Solid Propellant Flammability in Ambient Air," (December 1975) incorporated chemical additives in composite and high energy propellants. They found that several composite propellants were made more resistant to ignition, but that with high energy propellants, the continual resupply of air and reactant propellant materials overwhelms the contribution of additives and allows continued burning.

Aromatic amines such as diphenyl amine have been used to stabilize nitrate ester propellants. These amines are not compatible with nitramine explosives and could not be used with them as stabilizer.

OBJECTS OF THE INVENTION

It is an object of the invention to provide and disclose thermally stabilized nitramine explosive compositions.

It is a further object of the invention to provide and disclose nitramine explosive compositions containing additives and binders so as to resist thermal decomposition while allowing the additives and binders to contribute to the detonation when the composition is subject to a fully developed detonation wave from a booster.

It is a further object of the invention to provide and disclose nitramine explosive compositions which are resistant to the sequence of thermal reactions in explosives which occur as a result of undesirable thermal sources.

SUMMARY OF THE INVENTION

I have found that the addition of certain additives in combination with binders to a nitramine explosive improves the resistance of the resultant composition to ignition. Catalysts, promoters and accelerators may be used to improve the processing conditions or product.

THE INVENTION

The nitramine explosives treated were 2,4,6-trinitrotoluene (TNT); hexahydro-1,3,5 trinitro-1,3,5-triazine (RDX); and octahydro-1,3,5,7-tetranitro-1,3,5,7-tetrazocine (HMX); and 2,2 bis [(nitroxyl methyl)]-1,3-propanediol dinitrate (PETN). The amounts of explosive ranged from 41 to 85% by weight.

The operable additives include zinc borate, hexabromobiphenyl, molybdenum flame suppressant, triaryl phosphate ester, calcium formates, antimony oxide, ammonium phosphate, aluminum oxide trihydrate, organophosphorous diol, and halogenated binder components such as brominated vinyl esters. Amounts of additive varied from about 9 to 41% by weight. Smaller amounts may also give some protection.

Specific operable binders include polyurethanes, acrylic polymers, phosphate ester-vinyl chloride latexes, cellulose acetate butyrate, vinyl esters, styene-ewthylene-butylene block copolymers, fluorinated elastomers, and Plaster of Paris rubberized with acrylic latexes. The amounts of binder ranged from about 6 to 39% by weight. Plasticizers may be added to improve processing or final products properties.

Stabilized nitramine composites were prepared in accordance with the examplesdescribed hereinafter. The prepared composites were evaluated by subjecting the samples of the composition to Open Flame, Hot Wire and Cook-off tests.

The Open Flame test comprises subjecting the thermally stabilized explosive to an open flame to determine whether the material burns when engulfed in a flame.

The Hot Wire test was developed to simulate hot particle heating of explosive compositions. A bomb calorimeter fuse wire was inserted into a 1 cm cube of the composition by means of an incision. The wire was electrically heated by means of a set voltage to a bright orange color. The time lapsed until appearance of a flame or the wire breaks is recorded.

In the Cook-off test, explosive billets 6.25 cm by 15.2 cm were cast into a 1.27 cm wall thickness steel cylinder and heated electrically until the cylinder failed.

EXAMPLE 1

5.0 grams of RDX powder was slurried with 2.0 grams of distilled water in a small dish. 2.0 grams of a triaryl phosphate (FMC Kronitex 50) was added to the slurry. the triaryl phosphate displaces the water from the RDX powder. 3 grams of an isocyanate resin having a hydrophilic structure (3M sealing gel CR250) was added, to the mixture and thoroughly stirred. The isocyanate resin reaction with water induces a foam which produces a porous media with RDX distributed within the cell walls. The foam composition cures within 2 to 5 minutes. The cured material was subjected to explosive evaluation and found operable. The cured material was subjected to an Open Flame and did not burn.

EXAMPLE 2

The procedure of Example 1 was repeated using TNT and 10% by weight of FMC Kronitex 50. A cured sample of the material was subjected to an Open Flame test. The composition ignited with difficulty and then self-extinguished.

EXAMPLE 3

The procedure of Example 1 was repeated using HMX along with 10% FMC Kronitex and 25% by weight of 3M sealing gel CR250. A cured sample of the composition was subjected to an open flame test. The composition ignited with difficulty after 33 seconds compared with 8.3 seconds for an untreated composition of an identical size and configuration.

EXAMPLE 4

Example 1 was repeated except that all of the additives added to the 5 grams of RDX were reduced by 50%. The cured product was subjected to Open Flame and Hot Wire tests, respectively. The composition ignited with difficulty and then self-extinguished.

EXAMPLE 5

388.5 grams of class I RDX, 128.2 grams of class 5 RDX, and 55 grams of zinc borate were mixed in a steam-heated stainless steel vessel of about 2 liter capacity and heated to about 65° C. A solution composed of 4.5 grams of a block copolymer of styrene and block and ethylene butylene midblock (Kraton G1650) with 31.9 grams of a naphthenic hydrocarbon plasticizer and 40 cc of n-butyl acetate is thoroughly mixed with the solids to form a paste. The material can be hand stirred or mixed in planetary mixing equipment known in the energetic materials industry. On evaporation, a white powder is obtained. This composition may be pressed at room temperature at 51,200 P.S.1. to a density of 1.62 g/cc. A sample of the composition was subjected to Hot Wire and Open Flame tests. In comparison with an untreated composition, ignition was delayed.

EXAMPLE 6

350 grams of RDX powder (including 23 grams of associated water and isopropylalcohol) were mixed with an acrylic latex (B. F. Goodrich Hycar 2671) containing 79 grams of solids. 84 grams of Plaster of Paris were mixed thoroughly with the explosive. An additional 43 grams of Plaster of Paris were kneaded into the mixture by hand. On curing a castable composition is obtained. A sample of the composition was subjected to Hot Wire and Open Flame tests. In comparison with an untreated composition, ignition was delayed.

EXAMPLE 7

98 grams of a brominted vinyl ester resin (Dow Derakane 51ON), 1.5 grams of methyl ethyl ketoneperoxide having 8.8% active oxygen (Lupersol DHD-9) 0.3 grams of a solution of cobalt naphthenate having 6% cobalt and 0.05 grams of dimethyl aniline were mixed together. To the resultant mixture there was added 300 grams of class 1 RDX and 100 grams of class 5 RDX with thorough stirring. In order to allow more time for mixing the ingredients, the methylethyl ketoneperoxide may be added later or materials such as, 2,4-pentane diol may be added to delay the curing process. A castable, rigid composition forms within 24 hours. A sample of the composition was subjected to the Hot Wire and Open Flame tests. In comparison with an untreated composition, ignition was delayed.

It was concluded that the use of inhibitors in nitramine explosive compositions reduces the ignitability of the explosives.

Having described my invention, I claim:

1. A thermally stabilized, nitramine explosive comprising:

(a) an explosive selected from the group consisting of 2,4,6-trinitrotoluene; hexahydro-1,3,5-trinitro-1,3,5-triazine; and octahydro-1,3,5,7-tetranitro-1,3,5,7 tetrazocine (b) a triaryl phosphate additive in an amount of 10–20% based on the weight of the starting material.

(c) an isocyanate resin binder having a hydrophilic structure in an amount of 15–30% based on the weight of the starting material.

2. A composition in accordance with claim 1, wherein the explosive is octahydro-1,3,5,7 tetraniro-1,3,5,7-tetrazocine, the amount of triaryl phosphate additive is 10%, and the amount of isocyanate resin binder is 25% based on the weight of the starting materials.

* * * * *